US005135583A

United States Patent [19]

Gehmecker et al.

[11] Patent Number: 5,135,583

[45] Date of Patent: Aug. 4, 1992

[54] PHOSPHATING PROCESS

[75] Inventors: Horst Gehmecker, Hofheim; Thomas Kolberg, Heppenheim; Dirk Meyer, Frankfurt; Gerhard Müller, Hanau, all of Fed. Rep. of Germany

[73] Assignee: Metallgesellschaft Aktiengesellschaft, Frankfurt am Main, Fed. Rep. of Germany

[21] Appl. No.: 749,191

[22] Filed: Aug. 23, 1991

[30] Foreign Application Priority Data

Sep. 21, 1990 [DE] Fed. Rep. of Germany ..... 4029956

[51] Int. Cl.[5] ..... C23C 22/36

[52] U.S. Cl. ..... 148/262; 148/254

[58] Field of Search ..... 148/262, 254

[56] References Cited

FOREIGN PATENT DOCUMENTS 0385806 9/1990 European Pat. Off. ..... 148/254

*Primary Examiner*—Sam Silverberg

*Attorney, Agent, or Firm*—Herbert Dubno

[57] ABSTRACT

For phosphating metal surfaces which consist at least in part of aluminum, by means of phosphating solutions which contain zinc, phosphate and fluoride, any titanium which has entered the phosphating solution and would disturb the formation of the layer is precipitated by an addition of SiO-containing compounds and after the precipitate has been removed, the content of free fluoride is readjusted to the required concentration. Particularly suitable compounds which contain SiO, consist of alkali metasilicate, alkali orthosilicate and/or alkali disilicate, preferably used in an amount of 0.05 to 1 g/l of the phosphating solution, or of silica, which is preferably used in an amount of 0.5 to 10 g per liter of the phosphating solution (calc. as Si).

13 Claims, No Drawings

PHOSPHATING PROCESS

CROSS-REFERENCE TO RELATED APPLICATION

This application is related to commonly assigned copending application Ser. No. 07/691,129 filed 24 Apr. 1991.

FIELD OF THE INVENTION

Our present invention relates to a process for phosphating metal surfaces which consists at least in part of aluminum by a treatment with phosphating solutions which contain zinc, phosphate and fluoride.

BACKGROUND OF THE INVENTION

It is known that metal surfaces consisting of aluminum, steel and galvanized steel may be provided with thin phosphating layers forming a suitable base for coating with an organic paint.

In addition to zinc ions and phosphate ions, the phosphating solutions employed for this purpose may contain other ions including nickel, manganese, magnesium, calcium, copper, cobalt, alkali and/or ammonium. The phosphating solutions can also contain accelerating additives, such as nitrate, nitrite, chlorate, bromate, peroxide, m-nitrobenzene sulfonate, nitrophenol or combinations thereof. They may also contain anions, such as chloride, nitrate, and sulfate, for preserving electrical neutrality, and grain-refining additives, such as hydroxy-carboxylic acids, aminocarboxylic acids, or condensed phosphates.

Additionally, complex and/or simple fluorides can be present for the treatment particularly of aluminum and its alloys.

A problem which often arises in the phosphating of metal surfaces that consist entirely or in part of aluminum is that grey, uniformly closed zinc phosphate layers are not formed on the surface or surface portions of aluminum. Rather, coatings are formed which sometimes can even be wiped off. These coatings have unsatisfactory adherence and an unsatisfactory resistance to corrosion when a paint is subsequently applied.

OBJECTS OF THE INVENTION

It is an object of the invention to provide an improved phosphating process whereby this problem is obviated and which will cause satisfactory phosphate layers to be formed even on surfaces or surface portions consisting of aluminum.

Another object is to provide a process which yields improved phosphate coatings on aluminum substrates.

DESCRIPTION OF THE INVENTION

These objects are attained in a process which recognizes that the formation of an unsatisfactory layer is caused by the fact that titanium enters the phosphating solution in the form of titanium compounds or of soluble titanium particles. That titanium entering the solution may be entrained from activating solutions which contain titanium phosphate, or may be contained in the replenishing chemicals which are added, or as a result of a corrosion of plant materials which contain titanium, or from other sources.

Any titanium which has entered the phosphating solution and would disturb the formation of the coating is precipitated by the addition of SiO-containing compounds and when the precipitate has been removed, the content of free fluoride is readjusted to the required concentration. It is believed that the titanium is precipitated as a phosphate-containing compound.

The process of the invention thus comprises:

(a) contacting the metal surface consisting at least in part of aluminum with an aqueous phosphating solution containing zinc, phosphate and fluoride in a predetermined concentration for a period and at a temperature sufficient to form an adherent stable phosphate coating on the surface, the solution developing a titanium concentration above a maximum permissible concentration at which a quality of the coating deteriorates;

(b) treating at least a portion of the solution with at least one SiO-containing compound to form a precipitate of titanium in the solution, thereby reducing a concentration of titanium in the solution below the maximum permissible concentration and altering a free-fluoride concentration;

(c) removing the precipitate from the solution; and (d) readjusting the free fluoride concentration to a level sustaining the formation of the adherent and stable coating.

According to a preferred feature of the invention, the SiO-containing compound is added in the form of alkali metasilicates, alkali orthosilicates, alkali disilicates and/or silica.

It is preferred to add the SiO-containing compound or compounds in such a form that they have a concentration of 0.05 to 1 g/l in the phosphating solution if they are added as alkali metasilicates, alkali orthosilicates and/or alkali disilicates and have a concentration of 0.5 to 10 g/l in the phosphating solution if they are added as silica (calc. as Si).

If alkali silicates, such as metasilicates, orthosilicates or disilicates are added as SiO-containing compounds, it is advantageous, according to the invention, to add nitric acid and/or phosphoric acid at the same time or prior to the addition of the Si—O compound in an amount of 0.5 to 5 g $HNO_3$ (Calculated as 100%) and/or 0.75 to 7.5 g $H_3PO_4$ (calculated as 100%) per liter of the phosphating solution.

According to a further feature of the invention the precipitation of the titanium is assisted by the addition of iron (III), preferably in an amount of 0.01 to 0.25 g per liter of the phosphating solution.

The various process steps may be carried out intermittently after predetermined intervals of time or as required, during production interruptions.

In a particularly advantageous embodiment of the process, the process steps are continuously performed in a secondary circuit in such a manner that the concentration of titanium is constantly kept below a predetermined maximum.

The precipitate may be removed, e.g. by means of filters, centrifuges, inclined baffle plate clarifiers or sedimentation tanks.

The adjustment of the fluoride content to the desired concentration is most suitably effected electrometrically by means of a fluoride-sensitive electrode. In that case, the fluoride compound which is added is usually the same which has been used to prepare the phosphating solution.

A desirable feature of the invention resides in that the readjustment of the fluoride concentration is suitably accompanied by a simultaneous adjustment of the contents of the other components of the phosphating solution to their respective desired values.

By means of the process, in accordance with the invention, the concentration of titanium can be kept below the limit at which the formation of the phosphate layers on aluminum surfaces would adversely be affected. Specifically, it is possible to keep the titanium concentration below 10 mg/l, preferably below 5 mg/l to ensure the formation of a satisfactory phosphate layer.

Phosphating solutions which have already lost their ability to form satisfactory phosphate layers on aluminum surfaces can be reactivated by the process in accordance with the invention (i.e. the described removal of Ti) that the ability of the solutions to form satisfactory phosphate layers on aluminum surfaces is restored.

SPECIFIC EXAMPLE

The invention will be explained by way of example and in more detail with reference to the following Example:

EXAMPLE

A phosphating solution having the following composition was used in the phosphating stage of a dip-coating plant for forming phosphate coatings on sheet metal parts of aluminum, steel and galvanized steel:

1.4 g/l Zn
0.8 g/l Ni
1.0 g/l Mn
5.1 g/l Na
13.0 g/l Phosphate in terms of $P_2O_5$
7.1 g/l $NO_3$
0.12 g/l Si
0.1 g/l $NO_2$
1.2 g/l F
0.20 g/l F electrometrically measured
free acid: 1.6 points
total acid: 26.0 points
bath temperature: 53° C.
treating time: 3 minutes The phosphating stage was preceded by an activating stage, in which a titanium phosphate-containing suspension was used, which was composed of 30 mg/l Ti
300 mg/l Phosphate in terms of $P_2O_5$
270 mg/l Na
80 mg/l $CO_3$
60 mg/l $SO_4$ At the beginning of the treatment, the concentration of titanium in the phosphating solution was less than 1 mg/l. Each of the phosphate layers formed on steel, zinc, and aluminum was grey, finely crystalline, and closed.

Owing to an entraining of liquid from the activating bath adhering to the sheet metal parts coming from the activating step, the following results were obtained in the phosphating stage after a throughput of a surface area of 6000 $m^2$ per $m^3$ of bath solution:

on steel: grey, finely crystalline, closed phosphate layer
on zinc: grey, finely crystalline, closed phosphate layer
on aluminum: black coverings, which partly could be wiped off.

The concentration of titanium in the phosphating solution amounted to 15 mg/l.

Thereafter, the following additions were consecutively made to the phosphating solution per liter thereof:

2.0 g/l $HNO_3$ (calculated as 100%)
1.9 g/l $Na_2SiO_35H_2O$
0.1 g/l Fe(III) as $Fe(NO_3)_39H_2O$ The resulting precipitate was filtered off and the fluoride content (electrometrically) and the free acid were subsequently adjusted to the desired concentration. Thereafter, the titanium concentration was $\leqq$ 1 mg/l and grey, finely crystalline and closed phosphate layers were again formed on steel, zinc and aluminum.

We claim:

1. A process for phosphating a metal surface consisting at least in part of aluminum, comprising the steps of:
   (a) contacting said metal surface consisting at least in part of aluminum with an aqueous phosphating solution containing zinc, phosphate and fluoride in a predetermined concentration for a period and at a temperature sufficient to form an adherent stable phosphate coating on said surface, said solution developing a titanium concentration above a maximum permissible concentration at which a quality of said coating deteriorates;
   (b) treating at least a portion of said solution with at least one SiO-containing compound to form a precipitate of titanium in said solution, thereby reducing a concentration of titanium in said solution below said maximum permissible concentration and altering a free fluoride concentration;
   (c) removing said precipitate from said solution whereby a free fluoride concentration is altered; and
   (d) readjusting said free fluoride concentration to a level sustaining the formation of said adherent and stable coating.

2. The process defined in claim 1 wherein said SiO-containing compound is selected from the group which consists of alkali metal metasilicate, alkali metal orthosilicate, silica and alkali metal disilicate and mixtures thereof.

3. The process defined in claim 2 wherein said compound is added in an amount of 0.05 to 1 g of the SiO-containing compound per liter of said solution and said SiO-containing compound is selected from the group which consists of alkali metal metasilicate, alkali metal orthosilicate, and alkali metal disilicate and mixtures thereof.

4. The process defined in claim 2 wherein said compound is added in an amount of 0.5 to 10 g of the SiO-containing compound per liter of said solution and said SiO-containing compound is silica.

5. The process defined in claim 2 wherein said SiO-containing compound is selected from the group which consists of alkali metal metasilicate, alkali metal orthosilicate, and alkali metal disilicate and mixtures thereof, and an acid selected from the group which consists of 0.5 to 5g $HNO_3$ and 0.75 to 7.5 g $H_3PO_4$ and mixtures thereof per liter is added to said solution.

6. The process defined in claim 1, further comprising the step of promoting precipitation of titanium from said solution in step (b) by adding to said solution at least one iron(III) compound.

7. The process defined in claim 1 wherein steps (b) through (d) are carried out in a secondary flow of said solution diverted from and returned to a main body of said solution.

8. The process defined in claim 1 wherein step (d) is accompanied by simultaneous adjustment of zinc and phosphate concentrations in said solution to respective predetermined values 9. The process defined in claim 8 wherein said SiO-containing compound is selected from the group which consists of alkali metal metasilicate, alkali metal orthosilicate, silica and alkali metal disilicate and mixtures thereof.

10. The process defined in claim 9 wherein said compound is added in an amount of 0.05 to 1 g of the SiO-containing compound per liter of said solution and said SiO-containing compound is selected from the group which consists of alkali metal metasilicate, alkali metal orthosilicate, and alkali metal disilicate and mixtures thereof.

11. The process defined in claim 9 wherein said compound is added in an amount of 0.5 to 10 g of the SiO-containing compound per liter of said solution and said SiO-containing compound is silica.

12. The process defined in claim 9 wherein said SiO-containing compound is selected from the group which consists of alkali metal metasilicate, alkali metal orthosilicate, and alkali metal disilicate and mixtures thereof, and an acid selected from the group which consists of 0.5 to 5g $HNO_3$ and 0.75 to 7.5 g $H_3PO_4$ and mixtures thereof per liter is added to said solution.

13. The process defined in claim 9, further comprising the step of promoting precipitation of titanium from said solution in step (b) by adding to said solution at least one iron(III) compound.

* * * * *